US008159321B2

(12) United States Patent
Bollinger et al.

(10) Patent No.: US 8,159,321 B2
(45) Date of Patent: Apr. 17, 2012

(54) PRODUCTION METHOD FOR AN ELECTROMAGNETIC SWITCHING DEVICE HAVING PARTITION WALLS BETWEEN PRIMARY AND AUXILIARY CONTACTS AND AN ELECTROMAGNETIC SWITCHING DEVICE PRODUCED ACCORDING TO THE PRODUCTION METHOD

(75) Inventors: Georg Bollinger, Schwarzhofen (DE); Johann Drexler, Schwandorf (DE); Alexander Keintzel, Nürnberg (DE); Peter Schlegl, Altdorf (DE)

(73) Assignee: Siemens Aktiengesellschaft, Munich (DE)

( * ) Notice: Subject to any disclaimer, the term of this patent is extended or adjusted under 35 U.S.C. 154(b) by 370 days.

(21) Appl. No.: 12/450,728

(22) PCT Filed: Mar. 31, 2008

(86) PCT No.: PCT/EP2008/053801

§ 371 (c)(1),
(2), (4) Date: Oct. 9, 2009

(87) PCT Pub. No.: WO2008/125466

PCT Pub. Date: Oct. 23, 2008

(65) Prior Publication Data

US 2010/0127805 A1 May 27, 2010

(30) Foreign Application Priority Data

Apr. 13, 2007 (DE) ..... 10 2007 017 516

(51) Int. Cl.
*H01H 67/02* (2006.01)

(52) U.S. Cl. ..... 335/132; 335/2; 335/106; 335/107; 335/129; 335/131; 335/202; 200/243

(58) Field of Classification Search ..... 335/132, 335/202, 2, 10, 15, 86, 106, 107, 129, 131, 335/165, 167, 171, 185, 187, 188, 189, 192, 335/196, 197, 198; 200/240, 243, 245, 247, 200/250, 280, 447, 443, 149 B, 151, 16 R–16 D, 200/17 R, 239, 329
See application file for complete search history.

(56) References Cited

U.S. PATENT DOCUMENTS 3,296,567 A * 1/1967 Conner et al. ..... 335/126
(Continued)

FOREIGN PATENT DOCUMENTS

DE 1254737 B 11/1967

*Primary Examiner* — Mohamad Musleh
(74) *Attorney, Agent, or Firm* — Harness, Dickey & Pierce, P.L.C.

(57) ABSTRACT

In one embodiment of the present invention, a production method for an electromagnetic switching device includes the following steps in the sequence listed: producing a one-piece switching chamber, producing a contact bridge carrier and equipping the contact bridge carrier with movable contact bridges, wherein the contact bridges include a plurality of primary contact bridges and at least one auxiliary contact bridge; inserting the contact bridge carrier equipped with the movable contact bridges into the switching chamber; inserting partition elements into the switching chamber so that each partition element is arranged between a bridge contact point of one of the primary contact bridges and a bridge contact point of one of the auxiliary contact bridges, and equipping the switching chamber with fixed primary counter-contact points; fixing primary covers to the switching chamber so that the primary covers cover the primary counter-contact points and fix the partition elements in the switching chamber.

14 Claims, 6 Drawing Sheets

U.S. PATENT DOCUMENTS 3,324,431 A * 6/1967 Kussy et al. ..... 335/132
3,339,161 A * 8/1967 Conner et al. ..... 335/131
3,469,215 A * 9/1969 Brovedan ..... 335/132
3,544,929 A * 12/1970 Kussy et al. ..... 335/126
4,345,225 A * 8/1982 Lemmer ..... 335/132
4,443,675 A * 4/1984 Drexler et al. ..... 200/243
4,737,749 A * 4/1988 Held ..... 335/131
4,899,120 A * 2/1990 Ohtake et al. ..... 335/132
5,717,370 A * 2/1998 Haas ..... 335/132
6,411,184 B1 * 6/2002 Comtois et al. ..... 335/106
6,583,694 B2 6/2003 Comtois
6,628,184 B1 * 9/2003 Cassagrande et al. ..... 335/132

* cited by examiner

PRODUCTION METHOD FOR AN ELECTROMAGNETIC SWITCHING DEVICE HAVING PARTITION WALLS BETWEEN PRIMARY AND AUXILIARY CONTACTS AND AN ELECTROMAGNETIC SWITCHING DEVICE PRODUCED ACCORDING TO THE PRODUCTION METHOD

PRIORITY STATEMENT

This application is the national phase under 35 U.S.C. §371 of PCT International Application No. PCT/EP2008/053801 which has an International filing date of Mar. 31, 2008, which designated the United States of America, and which claims priority on German patent application number DE 10 2007 017 516.9 filed Apr. 13, 2007, the entire contents of each of which are hereby incorporated herein by reference.

FIELD

At least one embodiment of the present invention generally relates to a production method for an electromagnetic switching device. It also generally relates to an electromagnetic switching device.

BACKGROUND

Electromagnetic switching devices and production methods for electromagnetic switching devices are generally known. In particular an electromagnetic switching device is known to have the following features:

The switching device has a switching chamber and a contact bridge carrier.

The contact bridge carrier is equipped with movable contact bridges.

The contact bridges comprise a number of primary contact bridges and at least one auxiliary contact bridge.

The contact bridge carrier is inserted into the switching chamber and supported there in such a manner that it can be displaced longitudinally in an actuation direction.

The switching chamber is equipped with fixed primary counter-contact points and fixed auxiliary counter-contact points.

Each primary counter-contact point interacts with one of the bridge contact points of one of the primary contact bridges and each auxiliary counter-contact point interacts with one of the bridge contact points of one of the auxiliary contact bridges.

Primary covers are fixed to the switching chamber, so that the primary covers cover the primary counter-contact points.

In the prior art the primary contacts are used to connect a load voltage (typically three-phase current of up to 690 V rated voltage—in individual instances even more—or direct current voltage of up to 500 V rated voltage—in individual instances even more) to a load. The primary contacts are generally configured as normally open contacts. The auxiliary contacts are used to pick off the actual switching state of the electromagnetic switching device. To this end the auxiliary contacts switch a monitoring voltage, which is often much lower than the load voltage. It is typically either 24 V direct current voltage or 100/110/230 V alternating current voltage. Even higher voltage values are possible in individual instances. The auxiliary contacts can alternatively be configured as normally open contacts or normally closed contacts.

Contact erosion occurs at the primary contacts during switching processes. Contact erosion means that the primary contacts wear out after a certain number of switching cycles.

However contact erosion can also cause the function of the auxiliary contacts to be impaired, for example due to dirt or corrosion as a result of the penetration of aggressive gases, which result during contact erosion of the primary contacts. For this reason the primary contacts should be partitioned off as effectively as possible from the auxiliary contacts.

In the prior art it is known that the switching chamber can be configured in one piece and that ribs can be molded on the switching chamber. In contrast in this embodiment the contact bridge carrier has no ribs, etc. A so-called single labyrinth can be realized by means of this embodiment.

An electromagnetic switching device is known from U.S. Pat. No. 6,583,694 B2, wherein ribs are molded on both the switching chamber and on the contact bridge carrier, so that a so-called double labyrinth can be realized. However with this embodiment the switching chamber is made up of two parts, resulting in a greater manufacturing and assembly outlay.

SUMMARY

At least one embodiment of tof the present invention specifies a production method for an electromagnetic switching device and/or an electromagnetic switching device produced according to this production method, by which the primary contacts are effectively partitioned off from the auxiliary contacts despite the one-piece embodiment.

In respect of a method of at least one embodiment, a production method for an electromagnetic switching device comprises the following steps carried out in the sequence listed:

Producing a one-piece switching chamber, producing a contact bridge carrier and equipping the contact bridge carrier with movable contact bridges, with the contact bridges comprising a number of primary contact bridges and at least one auxiliary contact bridge;

Inserting the contact bridge carrier equipped with the movable contact bridges into the switching chamber;

Inserting partition elements into the switching chamber so that each partition element is arranged between a bridge contact point of one of the primary contact bridges and a bridge contact point of one of the auxiliary contact bridges, and equipping the switching chamber with fixed primary counter-contact points;

Fixing primary covers to the switching chamber so that the primary covers cover the primary counter-contact points and fix the partition elements in the switching chamber.

In respect of the facility of at least one embodiment, the electromagnetic switching device comprises the following features:

The switching device has a one-piece switching chamber and a contact bridge carrier.

The contact bridge carrier is equipped with movable contact bridges.

The contact bridges comprise a number of primary contact bridges and at least one auxiliary contact bridge.

The contact bridge carrier is inserted into the switching chamber and supported there in such a manner that it can be displaced longitudinally in an actuation direction.

Partition elements are inserted into the switching chamber, so that each partition element is arranged between a bridge contact point of one of the primary contact bridges and a bridge contact point of one of the auxiliary contact bridges.

The switching chamber is equipped with fixed primary counter-contact points and fixed auxiliary counter-contact points.

Each primary counter-contact point interacts with one of the bridge contact points of one of the primary contact bridges and each auxiliary counter-contact point interacts with one of the bridge contact points of one of the auxiliary contact bridges.

Primary covers are fixed to the switching chamber, so that the primary covers cover the primary counter-contact points and fix the partition elements in the switching chamber.

The individual elements of the switching device are tailored to one another in such a manner that insertion of the partition elements into the switching chamber and the equipping of the switching chamber with the fixed primary counter-contact points has to take place after insertion of the contact bridge carrier equipped with the movable contact bridges into the switching chamber and the fixing of the primary covers to the switching chamber has to take place after insertion of the partition elements into the switching chamber and the equipping of the switching chamber with the fixed primary counter-contact points.

Generally when viewed in the actuation direction each auxiliary contact bridge is arranged above one of the primary contact bridges respectively. It is possible with this embodiment for the partitioning off of the primary contacts from the auxiliary contacts to be effected solely by way of the partition elements. However the contact bridge carrier preferably has a tongue for each bridge contact point of each auxiliary contact bridge, said tongue extending between the bridge contact point of the respective auxiliary contact bridge and the bridge contact point of the corresponding primary contact bridge. This embodiment allows the partitioning effect to be optimized even further. In particular the partition elements together with the tongues can form a labyrinth.

In one example embodiment the partition elements have a U-shaped cross-section. This means that they are easy to produce and also still highly effective. Alternatively the partition elements can be simple flat tongues.

The switching chamber has to be equipped with the fixed auxiliary counter-contact points after the contact bridge carrier has been inserted into the switching chamber.

BRIEF DESCRIPTION OF THE DRAWINGS

Further advantages and details will emerge from the description which follows of an example embodiment in conjunction with the drawings of basic diagrams in which.

DETAILED DESCRIPTION OF THE EXAMPLE EMBODIMENTS

Figure 1:
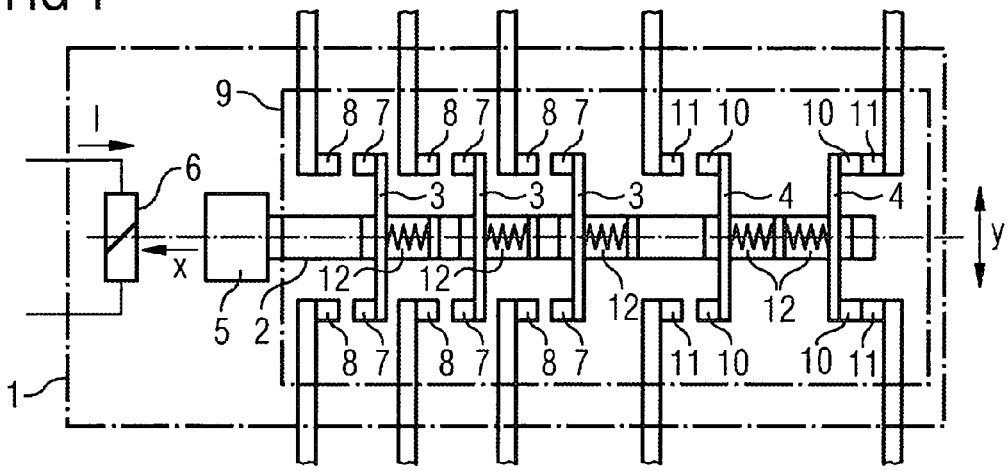
FIG. 1 shows a schematic illustration of an electromagnetic switching device.

An electromagnetic switching device has a housing 1. A contact bridge carrier 2 is supported in the housing 1. The contact bridge carrier 2 is equipped with movable primary contact bridges 3 and with movable auxiliary contact bridges 4. The contact bridge carrier 2 is made of an electrically insulating material. For example it can be configured as a plastic injection-molded part. It is connected to an armature 5.

A switching coil 6 is also arranged in the housing 1. When a sufficiently large current I is applied to the switching coil 6, it attracts the armature 5. This causes the contact bridge carrier 2 to be displaced longitudinally in an actuation direction x. The longitudinal displacement of the contact bridge carrier 2 causes bridge contact points 7 of the primary contact bridges 3 to be pressed onto fixed primary counter-contact points 8, which are arranged in a switching chamber 9. This allows a load (not shown) to be connected to a load voltage. The load voltage can be for example 400 V three-phase current, 500 V direct current voltage, 690 V three-phase current, etc. In such instances in particular the electromagnetic switching device is configured as a contactor.

Longitudinal displacement of the contact bridge carrier 2 causes auxiliary contacts 4, 10, 11 to be actuated as well as the primary contacts 3, 7, 8. Generally one of the primary contacts 4, 10, 11 respectively is configured as a normally closed and/or normally open contact. Thus on longitudinal displacement of the contact bridge carrier 2 for example bridge contact points 10 of the one of the auxiliary contacts 4, 10, 11 are pressed onto auxiliary counter-contact points 11 and bridge contact points 10 of the other of the auxiliary contacts 4, 10, 11 are lifted off corresponding auxiliary counter-contact points 11. The auxiliary counter-contact points 11 are fixed counter-contact points, with which the switching chamber 9 is equipped.

The diagram in FIG. 1, in which all the contact bridges 3, 4 are arranged one above the other when viewed in the actuation direction x is intended more to clarify the principles of the mode of operation of the electromagnetic switching device. In practice the primary contact bridges 3—see FIG. 2—are generally arranged next to one another, so that the following three directions define a right-angled Cartesian Coordinate System:

the actuation direction x, the primary direction of extension y of the contact bridges 3, 4 hereafter referred to as the contact bridge direction y, and the normal z to the two above-mentioned directions x, y, hereafter referred to as the normal direction z.

Figure 2:
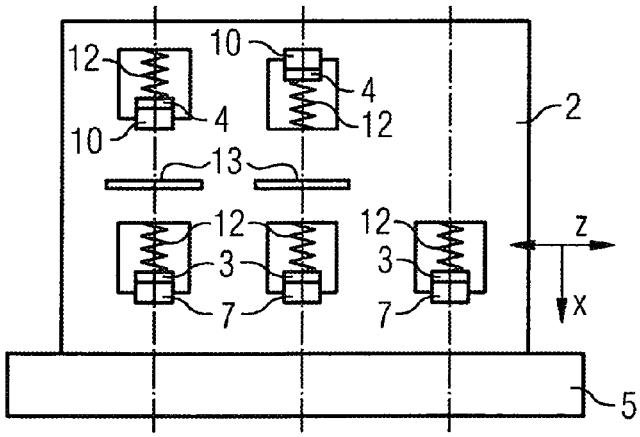
FIG. 2 shows a schematic illustration of an equipped contact bridge carrier.

It can also be seen from FIG. 2 that the contact bridges 3, 4 are held in predetermined rest positions by means of pressure springs 12. Finally it can also be seen from FIG. 2 that when viewed in the actuation direction x each auxiliary contact bridge 4 is arranged above one of the primary contact bridges 3 respectively.

Figure 3:
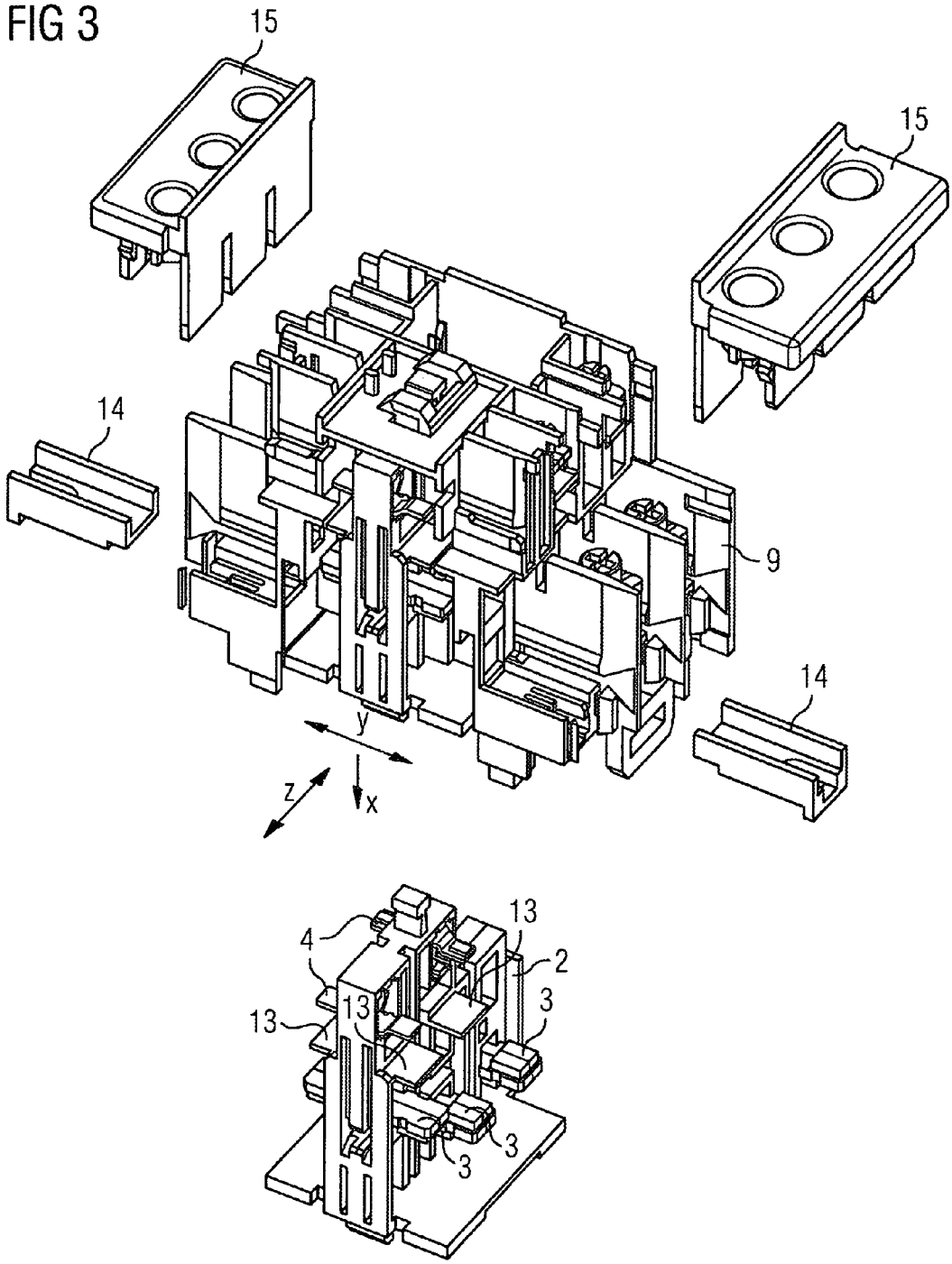
FIG. 3 shows an exploded illustration of essential parts of an electromagnetic switching device.

To produce an inventive electromagnetic switching device, the switching chamber 9 is produced first in the usual manner. With the present invention the switching chamber 9 is configured in one piece. It is made of an electrically insulating material. For example it can be configured as a plastic injection-molded part. Production of the switching chamber 9 is known generally to those skilled in the art and therefore does not have to be explained in more detail below. The switching chamber 9 is shown in FIG. 3.

The contact bridge carrier 2 is also produced and equipped with the movable contact bridges 3, 4. The equipped contact bridge carrier 2 is shown particularly clearly in FIG. 3 and FIG. 4. The contact bridges 3, 4 comprise a number of (generally three to five) primary contact bridges 3 and at least one (generally one or two) auxiliary contact bridges 4. The contact bridges 3, 4 are referred to as "movable" because they are moved together with the contact bridge carrier 2 during operation of the electromagnetic switching device. Each contact bridge 3, 4 has two bridge contact points 7, 10, which interact with the fixed counter-contact points 8, 11.

Figure 4:
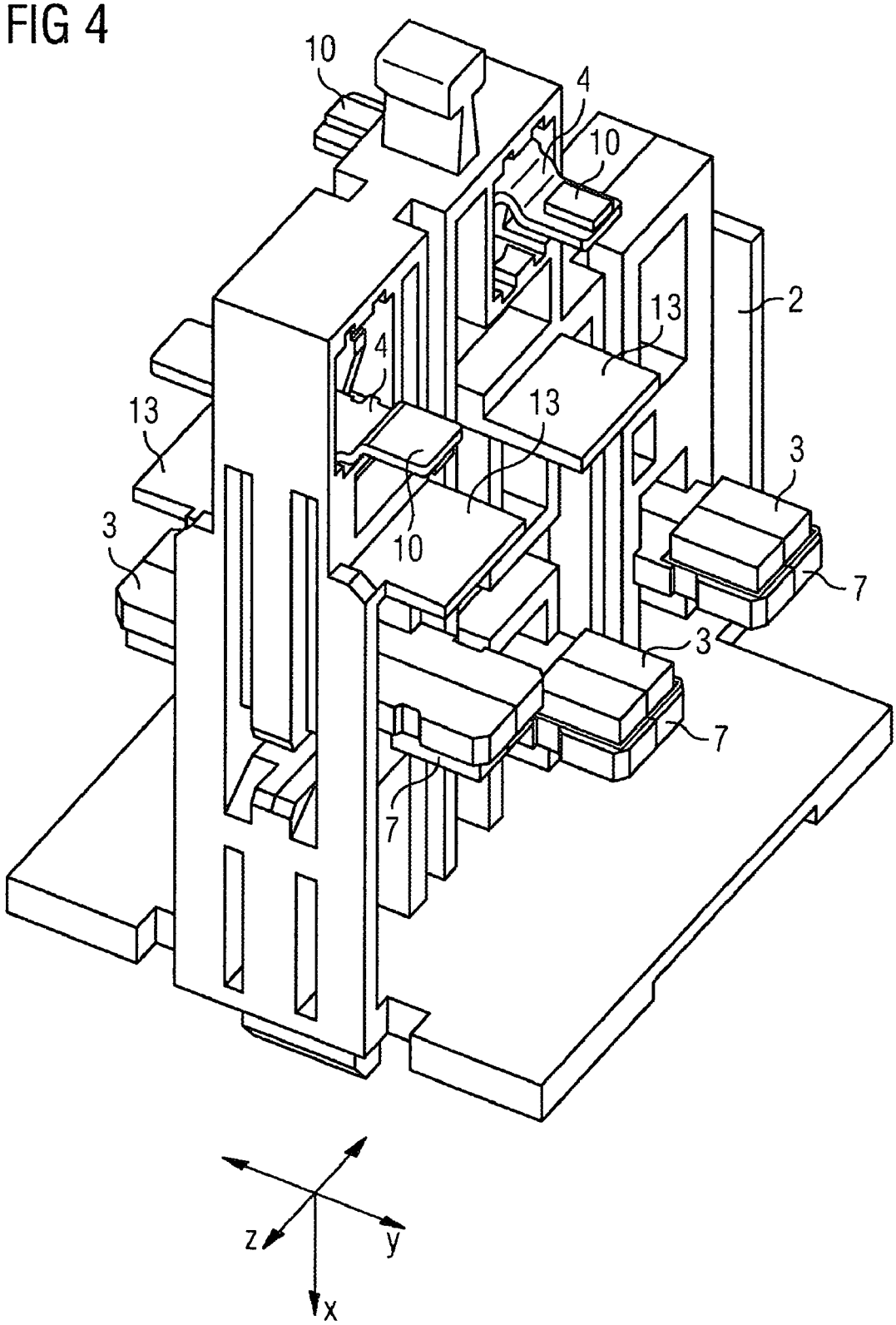
FIG. 4 shows a perspective view of a contact bridge carrier from FIG. 3.

As shown in particular in FIG. 4, the contact bridge carrier 2 also has a tongue 13 for each bridge contact point 10 of each auxiliary contact bridge 4. The tongues 13 here extend between the respective bridge contact point 10 of the respective auxiliary contact bridge 4 and the bridge contact point 7 of the corresponding primary contact bridge 3. The production and equipping of the contact bridge carrier 2 can alternatively take place before, at the same time as or after production of the switching chamber 9.

After the contact bridge carrier 2 has been equipped, the contact bridge carrier 2 is inserted into the switching chamber 9. Insertion of the contact bridge carrier 2 into the switching chamber 9 takes place here counter to the actuation direction x. After insertion into the switching chamber 9 it is also supported in such a manner that it can be displaced longitudinally in the actuation direction x.

Figure 5:
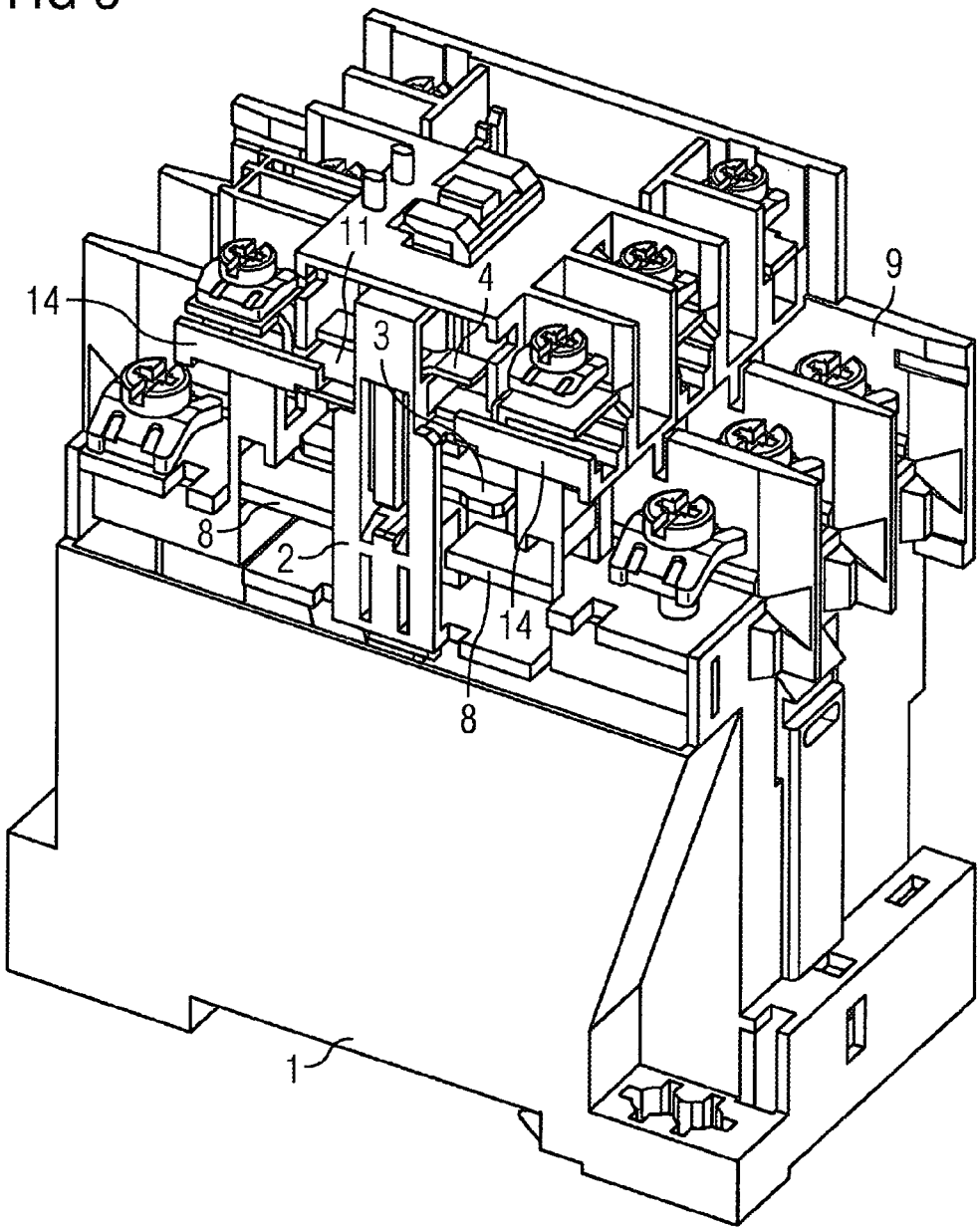
FIG. 5 shows a perspective view of the electromagnetic switching device from FIG. 3 with parts of the covers and side walls removed.
Figure 6:
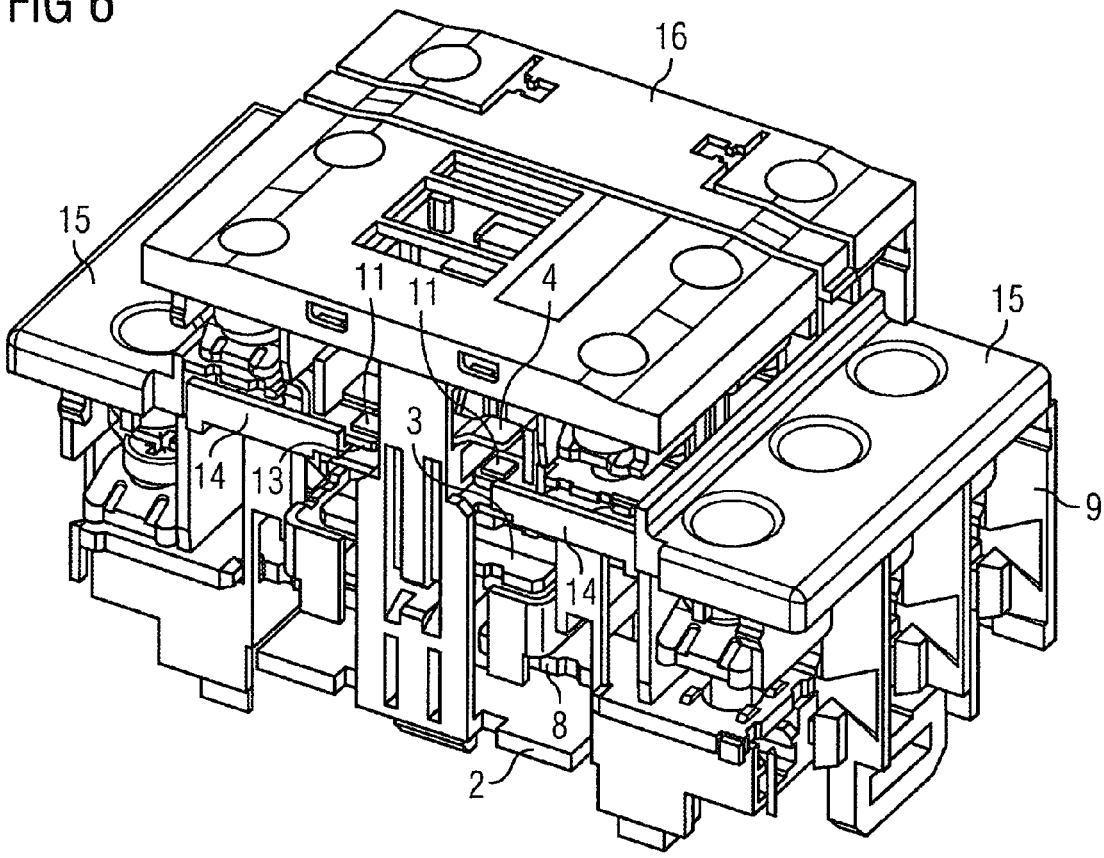
FIG. 6 shows a perspective view of the upper region of the electromagnetic switching device from FIG. 3.

Partition elements 14 are then inserted into the switching chamber 9. Insertion of the partition element 14 into the switching chamber 9 takes place here in the contact bridge direction y, from outside toward the contact bridge carrier 2. This is shown particularly clearly in FIG. 3. Insertion of the partition elements 14 into the switching chamber 9 means that each partition element 14 is arranged between a bridge contact point 7 of one of the primary contact bridges 3 and a bridge contact point 10 of one of the auxiliary contact bridges 4. This is shown particularly clearly in FIG. 5 and FIG. 6.

The switching chamber 9 is also equipped with the fixed primary counter-contact points 8 before, together with or after insertion of the partition elements 14 into the switching chamber 9. The primary counter-contact points 8 are referred to as "fixed" because they are arranged in a fixed position in the housing 1 or switching chamber 9, in other words they do not move together with the contact bridge carrier 2. As with insertion of the partition elements 14, the equipping of the switching chamber 9 with the primary counter-contact points 8 also takes place in the contact bridge direction y from outside toward the contact bridge carrier 2.

Finally primary covers 15 are fixed to the switching chamber 9. This is shown particularly clearly in FIG. 3. The primary covers 15 are fixed by pressing in the actuation direction x. For example the primary covers 15 can be latched or snapped onto the housing 1 or switching chamber 9. When the primary covers 15 are in the fixed state, the primary covers 15 cover the primary counter-contact points 8 on the one hand. They also fix the partition elements 14 in the switching chamber 9. This is shown particularly clearly in FIG. 6.

The switching chamber 9 is equipped with the fixed auxiliary counter-contact points 11 before, together with or after insertion of the partition elements 14 into the switching chamber 9 and the equipping of the switching chamber 9 with the fixed primary counter-contact points 8. The auxiliary counter-contact points 11 are referred to as "fixed" because they are arranged in a fixed position in the housing 1 or switching chamber 9, in other words they do not move together with the contact bridge carrier 2. The equipping of the switching chamber 9 with the auxiliary counter-contact points 11 also takes place in the contact bridge direction y from outside toward the contact bridge carrier 2. Equipping with fixed auxiliary counter-contact points 11 can in some circumstances even follow the fixing of the primary cover 15 to the switching chamber 9.

After equipping with the fixed auxiliary counter-contact points 11 at least one auxiliary cover 16 is fixed to the switching chamber 9 and covers the auxiliary counter-contact points 11 after fixing. The fixing of the auxiliary cover 16 generally—but not necessarily—takes place after the fixing of the primary covers 15.

With an embodiment of the inventive electromagnetic switching device the individual elements 1 to 16 of the switching device are tailored to one another in such a manner that insertion of the partition elements 14 into the switching chamber 9 and the equipping of the switching chamber 9 with the fixed primary counter-contact points 8 and the fixed auxiliary counter-contact points 11 has to take place after insertion of the contact bridge carrier 2 equipped with the movable contact bridges 3, 4 into the switching chamber 9, as the partition elements 14, the primary counter-contact points 8 and the auxiliary counter-contact points 11 project into the insertion space required for insertion of the equipped contact bridge carrier 2.

The individual elements 1 to 16 of the switching device are also tailored to one another in such a manner that the fixing of the primary covers 15 to the switching chamber 9 has to take place after insertion of the partition elements 14 into the switching chamber 9 and after the equipping of the switching chamber 9 with the fixed primary counter-contact points 8, as it is no longer possible to insert the partition elements 14 and the primary counter-contact points 8 into the switching chamber after the primary covers 15 have been fixed. In some embodiments the auxiliary counter-contact points 11 also have to be inserted before the primary covers 15 are fixed. In other embodiments equipping with the fixed auxiliary counter-contact points 11 can (or must—depending on the embodiment) take place after the fixing of the primary cover 15.

Figure 8:
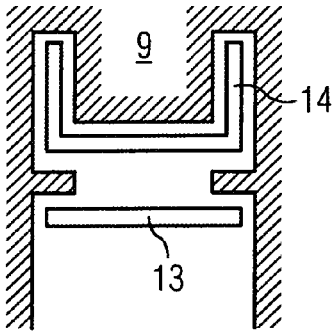
FIG. 8 shows a detail of the electromagnetic switching device from FIG. 3.

The tongues 13 of the contact bridge carrier 2 are—see FIG. 8—arranged between the partition elements 14 and the bridge contact points 7 of the primary contact bridges 3. According to FIG. 8 together with the partition elements 14 they form a—preferably double—labyrinth. The partitioning effect achieved here is particularly effective, if the partition elements 14 have a U-shaped cross-section. This can also be seen in FIG. 8. Alternatively the partition elements 14 can be configured as simple tongues for example.

Figure 7:
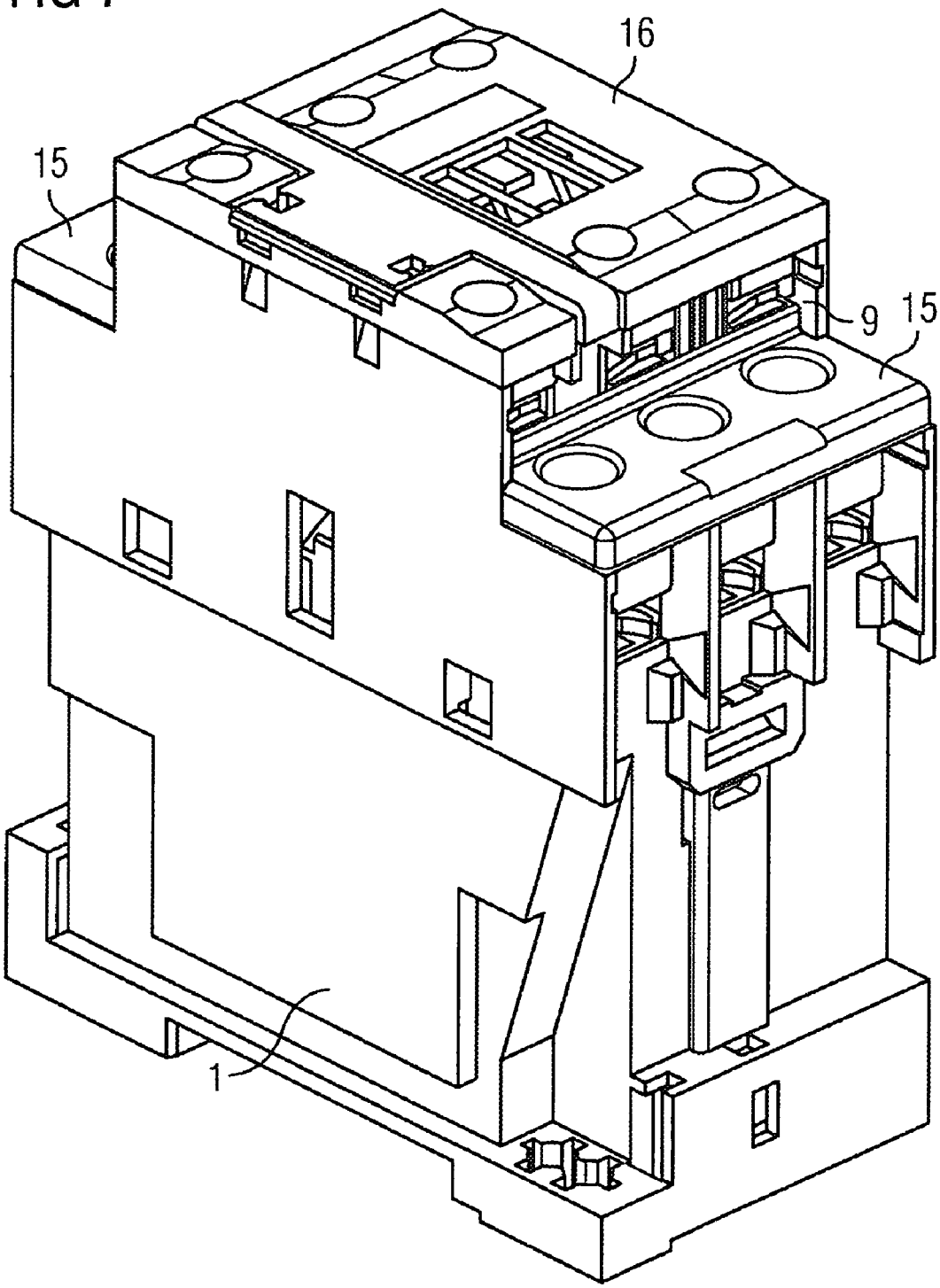
FIG. 7 shows a perspective view of the complete electromagnetic switching device from FIG. 3

Embodiments of the present invention have many advantages. In particular a simple, reliable and economical structure of the electromagnetic switching device results. The contact bridge carrier 2 can also be equipped beforehand (in other words before insertion into the switching chamber 9). It is also possible to realize a double labyrinth in a simple manner. Finally—see in particular FIG. 7—a compact overall structure of the electromagnetic switching device results.

The above description is only intended to clarify the present invention. The scope of protection of the present invention should in contrast only be determined by the accompanying claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A production method for an electromagnetic switching device, in particular a contactor, the method comprising:

producing a one-piece switching chamber, producing a contact bridge carrier and equipping the contact bridge carrier with movable contact bridges, with the contact bridges comprising a number of primary contact bridges and at least one auxiliary contact bridge;

inserting the contact bridge carrier equipped with the movable contact bridges into the switching chamber;

inserting partition elements into the switching chamber so that each partition element is arranged between a bridge contact point of one of the primary contact bridges and a bridge contact point of one of the auxiliary contact bridges, and equipping the switching chamber with fixed primary counter-contact points; and fixing primary covers to the switching chamber so that the primary covers cover the primary counter-contact points and fix the partition elements in the switching chamber.

2. The production method as claimed in claim 1, wherein the switching chamber is equipped with fixed auxiliary counter-contact points and the switching chamber is equipped with the fixed auxiliary counter-contact points after the contact bridge carrier has been inserted into the switching chamber.

3. The production method as claimed in claim 1, wherein the electromagnetic switching device is a contactor.

4. An electromagnetic switching device, comprising:

a one-piece switching chamber; and a contact bridge carrier, the contact bridge carrier being equipped with movable contact bridges, the contact bridges including a number of primary contact bridges and at least one auxiliary contact bridge, the contact bridge carrier being inserted into the switching chamber and supported there, in such a manner, that to be longitudinally displaceable in an actuation direction, wherein partition elements are inserted into the one-piece switching chamber, so that each partition element is arranged between a bridge contact point of one of the primary contact bridges and a bridge contact point of one of the auxiliary contact bridges, wherein the one-piece switching chamber is equipped with fixed primary counter-contact points and fixed auxiliary counter-contact points, wherein each primary counter-contact point interacts with one of the bridge contact points of one of the primary contact bridges and each auxiliary counter-contact point interacts with one of the bridge contact points of one of the auxiliary contact bridges, wherein primary covers are fixed to the switching chamber such that the primary covers cover the primary counter-contact points and fix the partition elements in the switching chamber, and wherein individual elements of the switching device are tailored to one another in such a manner that insertion of the partition elements into the switching chamber and the equipping of the switching chamber with the fixed primary counter-contact points has to take place after insertion of the contact bridge carrier equipped with the movable contact bridges into the switching chamber and the fixing of the primary covers to the switching chamber has to take place after insertion of the partition elements into the switching chamber and the equipping of the switching chamber with the fixed primary counter-contact points.

5. The switching device as claimed in claim 4, wherein when viewed in the actuation direction, each auxiliary contact bridge is arranged above one of the primary contact bridges respectively and the contact bridge carrier has a tongue for each bridge contact point of each auxiliary contact bridge, said tongue extending between the bridge contact point of the respective auxiliary contact bridge and the bridge contact point of the corresponding primary contact bridge.

6. The switching device as claimed in claim 5, wherein the partition elements together with the tongues form a labyrinth.

7. The switching device as claimed in claim 6, the partition elements have a U-shaped cross-section.

8. The switching device as claimed in claim 6, wherein the individual elements of the switching device are tailored to one another in such a manner that the equipping of the switching chamber with the fixed auxiliary counter-contact points has to take place after insertion of the contact bridge carrier into the switching chamber.

9. The switching device as claimed in claim 5, the partition elements have a U-shaped cross-section.

10. The switching device as claimed in claim 5, wherein the individual elements of the switching device are tailored to one another in such a manner that the equipping of the switching chamber with the fixed auxiliary counter-contact points has to take place after insertion of the contact bridge carrier into the switching chamber.

11. The switching device as claimed in claim 4, the partition elements have a U-shaped cross-section.

12. The switching device as claimed in claim 11, wherein the individual elements of the switching device are tailored to one another in such a manner that the equipping of the switching chamber with the fixed auxiliary counter-contact points has to take place after insertion of the contact bridge carrier into the switching chamber.

13. The switching device as claimed in claim 4, wherein the individual elements of the switching device are tailored to one another in such a manner that the equipping of the switching chamber with the fixed auxiliary counter-contact points has to take place after insertion of the contact bridge carrier into the switching chamber.

14. The switching device as claimed in claim 4, wherein the electromagnetic switching device is a contactor.

* * * * *